US009839825B1

(12) United States Patent
Watkins

(10) Patent No.: US 9,839,825 B1
(45) Date of Patent: Dec. 12, 2017

(54) HEAD COVER FOR GOLF IRONS

(71) Applicant: Hunter Watkins, Brooklyn, NY (US)

(72) Inventor: Hunter Watkins, Brooklyn, NY (US)

( * ) Notice: Subject to any disclaimer, the term of this patent is extended or adjusted under 35 U.S.C. 154(b) by 0 days.

(21) Appl. No.: 15/252,318

(22) Filed: Aug. 31, 2016

(51) Int. Cl.
*A63B 55/00* (2015.01)
*A63B 60/62* (2015.01)

(52) U.S. Cl.
CPC ..... *A63B 60/62* (2015.10)

(58) Field of Classification Search
CPC ..... A63B 55/404; A63B 60/62
USPC ..... 150/160; 206/315.4
See application file for complete search history.

(56) References Cited

U.S. PATENT DOCUMENTS 2,471,169 A * 5/1949 Salzberg ..... A63B 55/00 150/159
4,955,472 A * 9/1990 Yamazoe ..... A63B 55/00 150/160
5,299,611 A * 4/1994 Cirone ..... A63B 60/62 150/160
6,659,275 B1 * 12/2003 Yoon ..... A63B 55/00 150/160
8,584,861 B2 * 11/2013 Porath ..... A45C 9/00 206/315.2

* cited by examiner

*Primary Examiner* — Sue A Weaver
(74) *Attorney, Agent, or Firm* — Barlow, Josephs & Holmes, Ltd.

(57) ABSTRACT

A unitary head cover for a set of golf irons includes a body portion having a length, a width, a first end and a second end. The first end is opposite the second end along the length of the body portion. The body portion has a first side and a second side opposite the first side. A plurality of pockets is spaced about the length of the body portion from the first end to the second end. The pockets may be spaced successively on the body portion, alternating between the first side and the second side. Each of the pockets is progressively sized and dimensioned to receive a head of a golf iron therein.

20 Claims, 2 Drawing Sheets

HEAD COVER FOR GOLF IRONS

BACKGROUND OF THE INVENTION

1. Field of the Invention

The present patent document relates generally to protective covers for golf clubs and more particularly to a unitary head cover for a set of golf irons.

2. Background of the Related Art

Golf club head covers are known in the art. However, prior art head covers are typically individually fitted to each club head, which, when removed, may become lost. Although lanyards have been used to prevent loss of individual head covers, lanyards have the disadvantage of becoming tangled and, thus, irritating to the golfer. Therefore, there is a perceived need in the prior art for a golf club head cover that is not easily lost and lacks lanyards that may become tangled.

SUMMARY OF THE INVENTION

The present head cover for golf irons, including wedges, solves the problems of the prior art by providing a head cover that includes a body portion having a length, a width, a first end and a second end, with a plurality of pockets spaced about the length of the body portion from the first end to the second end. The first end is opposite the second end along the length of the body portion. The body portion has a first side and a second side opposite the first side. The pockets may be spaced successively on the body portion, alternating between the first side and the second side. Each of the pockets is progressively sized and dimensioned to receive a head of a golf iron therein. The cover is also made from a neoprene material which both protects the irons and reduces noise and rattling when carrying the irons in a golf bag.

Accordingly, among the objects of the head cover is a head cover that prevents loss of individual head covers for golf irons.

Another object of the head cover is a head cover that prevents rattling of the golf irons.

Yet another object of the disclosed head cover is a head cover that lacks lanyards and therefore cannot become entangled.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
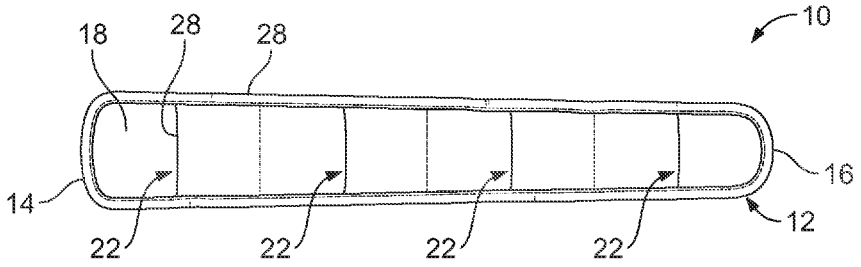
FIG. 1 is an elevation view of a first side of an embodiment of the head cover.
Figure 2:
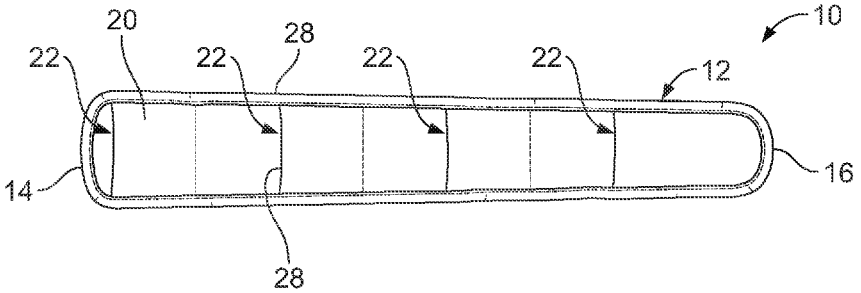
FIG. 2 is an elevation view of a second side of an embodiment of the head cover.
Figure 3:
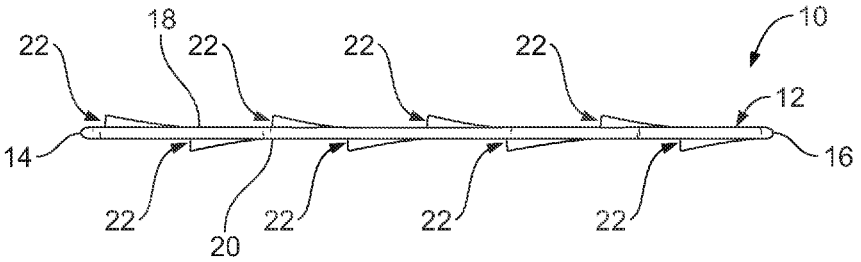
FIG. 3 is a top view of an embodiment of the head cover.
Figure 4:
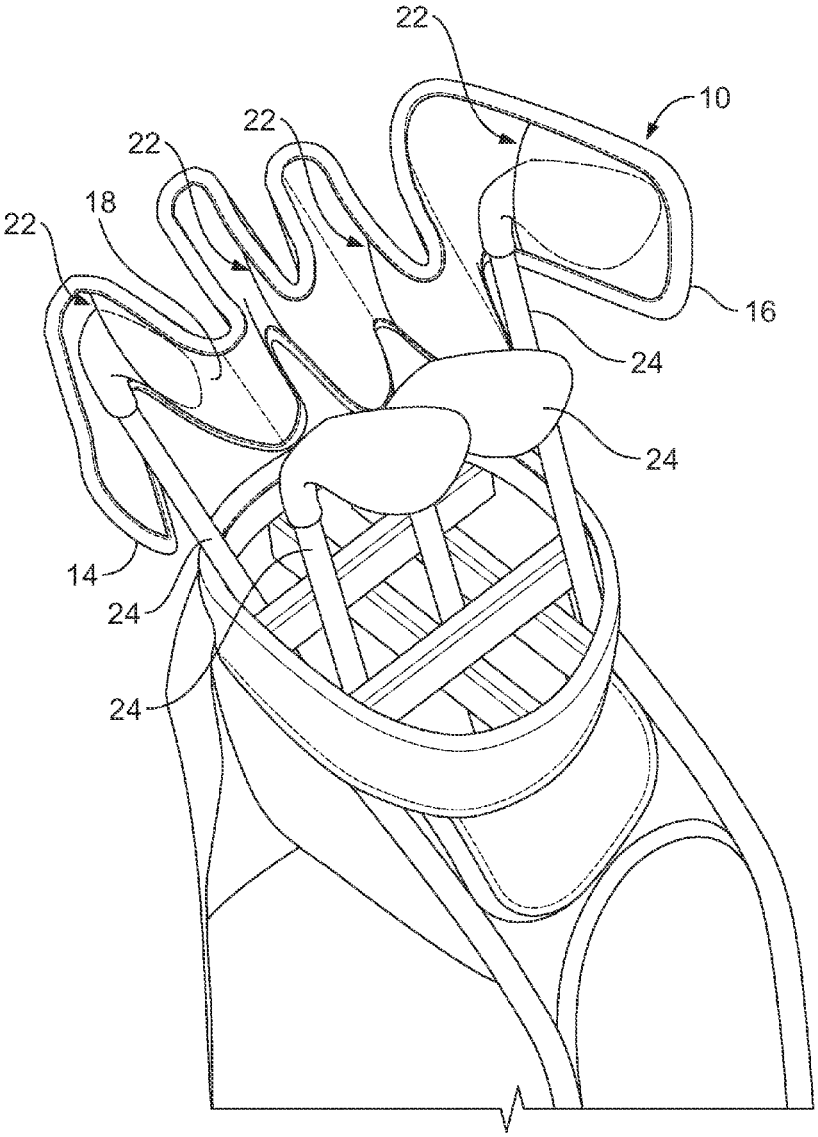
FIG. 4 is a perspective view of golf irons being inserted into an embodiment of the head cover.

Referring now to FIGS. 1-4, a head cover for a set of golf irons is shown generally at 10. The term "golf irons" includes numbered irons and wedges, such as sand wedges and lob wedges. The head cover 10 includes a body portion 12 having a length, a width, a first end 14 and a second end 16. The first end 14 is opposite the second end 16 along the length of the body portion 12. The body portion 12 has a first side 18 and a second side 20 opposite the first side 18. A plurality of pockets 22 is spaced about the length of the body portion 12 from the first end 14 to the second end 16. The pockets 22 may be spaced successively on the body portion 12, alternating between the first side 18 and the second side 20. Each of the pockets 22 is progressively sized and dimensioned to receive a head of one of the golf irons 24 in a set. As is known in the art, the lower numbered irons are slightly smaller and have a more vertical loft while the higher numbered irons are larger and have a more angled loft which gives them a wider profile. Accordingly, the pockets 22 are progressively sized to fit the progressively larger and larger irons from 2-PW.

It is an important feature of the invention that the head cover 10 protects and prevents rattling of the golf irons 24 while in a golf bag 26. Furthermore, the act of sliding the head of the golf iron 24 into and out of a pocket 22 cleans the head of the golf iron 24 of debris, such as soil and grass collected on the head of the golf iron 24. Accordingly, the head cover 10 also acts as a cleaning towel or wipe.

The body portion 12 may be made from a soft flexible material, such as neoprene or neoprene fabric. Other materials may be used as desired. In a typical golf bag, the length of the body portion 12 may be about 38", width at the first end 14 about 4", width at the second end 16 about 3", and the thickness may be about ⅜". Other dimensions may be used as appropriate for a particular set or number of irons. Decorative colors, prints and the like may be formed on the body portion 12 to enhance the appeal of the head cover 10. The body portion 12 may include reinforcing 28 about an outer perimeter of the body portion 12 to prevent tearing and separation of the material of the body portion 12. Additional reinforcing 28 may be formed at the opening of each pocket 22. The reinforcing 28 may include additional, heavier edging material (piping) with added stitching to the body portion 12.

The pockets 22 may be formed from material sewn or attached to the body portion 12, or, alternatively, formed integrally with the body portion 12. Although the openings of the pockets 22 on both the first side 18 and the second side 20 are shown all facing the first end 14, some or all of the openings of the pockets 22 could be arranged to face the second end 16. For instance, the openings of the pockets 22 on the first side 18 could be arranged to face the first end 14 while the openings of the pockets 22 on the second side 20 could be arranged to face towards the second end 16.

In use, the head cover 10 is placed on the golf irons 24 while the golf irons 24 are stored in the golf bag 26. Because the body portion 12 of the head cover 10 tapers from wider to narrower the pockets 22 are larger at the first end 14 and narrower at the second end 16. As described hereinabove, golf irons with more loft are larger than golf irons with less loft because the angle of the face of the golf iron must be necessarily larger. The differently sized pockets 22 thus allow golf irons 22 of decreasing loft to be stored within the pockets 22 from largest loft starting at the pocket 22 nearest first end 14 to smallest loft at the pocket 22 nearest the second end 16. Because the body portion 10 of the head cover 10 is a soft, flexible material, the head cover is folded between each golf iron 24 prior to insertion of each golf iron 22 into its respective pocket 22 (best seen in FIG. 4). This folding arrangement provides added protection to the golf irons 24 and secures the head cover 10 in place over the set of golf irons 24.

Therefore, it can be seen that the present invention provides a unique solution to the problem of providing a golf club head cover wherein individual covers will not become lost and that does not need or require a lanyard.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A head cover for a set of golf irons, comprising:

a body portion having a length, a width, a first end and a second end, the first end opposite the second end on the length of the body portion; and a plurality of pockets, spaced about the length of the body portion from the first end to the second end;

wherein each of the plurality of pockets is progressively sized and dimensioned, from larger to smaller, to receive a head of a golf iron from a set of golf irons therein.

2. The head cover of claim 1, wherein at least a portion of the plurality pockets is formed on a first side of the body portion.

3. The head cover of claim 2, wherein at least a portion of the plurality of pockets is formed on a second side of the body portion.

4. The head cover of claim 3, wherein the plurality of pockets alternate sequentially between the first side and the second side.

5. The head cover of claim 1, wherein the plurality of pockets is spaced equally about the length of the body portion.

6. The head cover of claim 1, wherein the body portion is formed from a soft flexible material.

7. The head cover of claim 6, wherein the soft flexible material is neoprene fabric.

8. The head cover of claim 1, wherein the width of the body portion tapers along the length wherein the first end is wider than the second end.

9. The head cover of claim 1, wherein the width at the first end is about four inches.

10. The head cover of claim 1, wherein the width at the second end is about three inches.

11. The head cover of claim 1, wherein the length of the body portion is about thirty eight inches.

12. The head cover of claim 1, wherein the body portion has a thickness of about three eights of an inch.

13. A head cover for a set of golf irons, comprising:

a body portion having a length, a width, a first end and a second end, the first end opposite the second end on the length of the body portion, the body portion having a first side and a second side opposite the first side; and a plurality of pockets, spaced about the length of the body portion from the first end to the second end, wherein the plurality of pockets is spaced successively on the body portion, alternating between the first side and the second side;

wherein each of the plurality of pockets is progressively sized and dimensioned, from larger to smaller, to receive a head of a golf iron from a set of golf irons therein.

14. The head cover of claim 13, wherein the body portion is formed from a soft flexible material.

15. The head cover of claim 14, wherein the soft flexible material is neoprene fabric.

16. The head cover of claim 13, wherein the width of the body portion tapers along the length wherein the first end is wider than the second end.

17. The head cover of claim 13, wherein the width at the first end is about four inches.

18. The head cover of claim 13, wherein the width at the second end is about three inches.

19. The head cover of claim 13, wherein the length of the body portion is about thirty eight inches.

20. The head cover of claim 13, wherein the body portion has a thickness of about three eights of an inch.

* * * * *